US007185928B1

(12) United States Patent
Liao

(10) Patent No.: US 7,185,928 B1
(45) Date of Patent: Mar. 6, 2007

(54) STRUCTURE OF MAGNETIC LOCK

(76) Inventor: Li-Shih Liao, No. 3, Lane 32, Gaocing Road, Yangmei Township, Taoyuan County 326 (TW)

( * ) Notice: Subject to any disclaimer, the term of this patent is extended or adjusted under 35 U.S.C. 154(b) by 15 days.

(21) Appl. No.: 11/246,061

(22) Filed: Oct. 11, 2005

(51) Int. Cl.
*E05B 15/02* (2006.01)

(52) U.S. Cl. ..... 292/341.16; 292/341.15

(58) Field of Classification Search ..... 292/341.15, 292/341.16, 340
See application file for complete search history.

(56) References Cited

U.S. PATENT DOCUMENTS 4,211,443 A * 7/1980 Butts et al. ..... 292/341.16
5,219,196 A * 6/1993 Luker ..... 292/341.16
6,874,830 B2 * 4/2005 Bashford ..... 292/341.16
7,021,684 B2 * 4/2006 Orbeta et al. ..... 292/341.16

* cited by examiner

*Primary Examiner*—Gary Estremsky
(74) *Attorney, Agent, or Firm*—Rosenberg, Klein & Lee

(57) ABSTRACT

A magnetic lock is disclosed to include a latch for locking, a movable holder member supported on a spring and carrying solenoid, which has a plunger and a stop block fastened to the plunger for controlling the retraction of the latch, and an adjustment device selectively positioned in one of two positioning grooves of different depths in a locating block and stopped at one end of the holder member against the spring for controlling the movable holder member between a first position where the magnetic lock is locked when electrically connected and a second position where the magnetic lock is unlocked when electrically connected.

9 Claims, 9 Drawing Sheets

STRUCTURE OF MAGNETIC LOCK

BACKGROUND OF THE INVENTION

1. Field of the Invention

The present invention relates to locks and more particularly, to a magnetic lock that can be conveniently and selectively adjusted between two reversed modes, allowing the magnetic lock to be locked or unlocked when electrically connected.

2. Description of the Related Art

Conventional magnetic locks include two types, the type that is locked when electrically connected, and the type that is unlocked when electrically connected. It greatly complicates the manufacturer's inventory control and the related management cost to fabricate these two types of magnetic locks.

Taiwan patent publication no. 384904, filed by the present inventor on Apr. 14, 1998, discloses a magnetic lock, which has the electromagnetic valve adjustable between two positions to have the magnetic lock be locked or unlocked when electrically connected.

U.S. Pat. No. 6,299,225 issued on Oct. 9, 2001, discloses a magnetic lock entitled "Electrical Lock Device". According to this design, as shown in FIGS. 1A and 1B, comprises a housing 60, a lever 61, a solenoid device 62, a top cover 63, and a shell 64. The solenoid device 62 is mounted on a mount 621, having a plunger 622 slidably received therein and a block 623 secured to the plunger 622. The mount 621 has bottom screw holes 624. The housing 60 has an elongated slot 65, and two screw holes 66 spaced from the elongated slot 65 at different distances. A adjustment screw 67 and a tie screw 68 are respectively mounted in the elongated slot 65 and one screw hole 66 of the housing 60 and threaded into corresponding screw holes 624 to alternatively secure the mount 621 in the space 601 inside the housing 60 at a position where the solenoid device 62 is disengaged from the lever 61 when the solenoid device 62 is energized and at the other position where the solenoid device 62 is engage with the lever 61 when the solenoid device 62 is energized. When wishing to change the position of the solenoid device 62 (the mount 621), the user must remove the top cover 63 and unfasten the tie screw 68. This solenoid device position adjustment procedure is complicated.

U.S. Pat. No. 6,874,830 discloses another structure of magnetic lock, entitled "Electric Strike Assembly". According to this design, the electric strike assembly comprises a housing 70, a keeper 71 pivotally arranged in the housing 70, and a holder 73 slidably arranged in the housing 70, a blocking element 74 slidably arranged in the holder, 73 and configured to selectively prevent a rotation of the keeper 71 and allow the rotation of the keeper 71, an actuator 72 configured to selectively move the blocking element 74, a two-position mode selector 76 operable from outside the housing 70 and configured to selectively move the holder 73 from a first position to a second position and vice versa, and a bottom cover 77 covering the housing 70. The selector 76 has a slotted head 61, an eccentric disc portion 63, and a pin 62. When the holder 73 is in the first position, the blocking member 74 allows the rotation of the keeper 71 when the actuator 72 is energized and prevents the rotation of the keeper 71 when the actuator 72 is not energized, and when the holder 73 is in the second position, the blocking member 74 prevents the rotation of the keeper 71 when the actuator 72 is energized and allows the rotation of the keeper 71 when the actuator 72 is not energized. This design of magnetic lock is complicated. Further, it is inconvenient to operate the selector 76 to further adjust the position of the holder 73.

SUMMARY OF THE INVENTION

The present invention has been accomplished under the circumstances in view. It is therefore the main object of the present invention to provide a magnetic lock, which is conveniently adjustable between two modes to have the magnetic lock be locked or unlocked when electrically connected.

To achieve this and other objects of the present invention, the magnetic lock comprises a bottom cover shell; a top cover shell mounted on the bottom cover shell; a latch movably mounted inside the top cover shell, the latch having at least one lug; a movable holder member mounted inside the top cover shell; a positioning structure adapted to hold the movable holder member in the top cover shell in position; and a solenoid mounted on the movable holder member, the solenoid device having a plunger slidably received therein and a stop block fastened to the plunger and adapted to act relative to the at least one lug of the latch to control movement of the keeper; wherein the positioning structure comprises a spring member provided at one end of the top cover shell and stopped against one end of the movable holder member, a locating block provided at an opposite end of the top cover shell and aimed at the spring member, the locating block having an axle hole, a transverse groove for supporting the movable holder member in a first position, and a longitudinal groove for supporting the movable holder member in a second position, the transverse groove and the longitudinal groove being formed on a front face of the locating block at different depths, and an adjustment device mounted in the axle hole of the locating block and stopped at one end of the movable holder member opposite to the spring member and adjustable to control the position of the movable holder member between the first position and the second position, the adjustment device being a rod member mounted in the axle hole and having at least one peripheral pin for selectively positioning in the transverse groove and the longitudinal groove to selectively support the movable holder member in the first position and the second position.

DETAILED DESCRIPTION OF THE PREFERRED EMBODIMENT

Figure 1A:
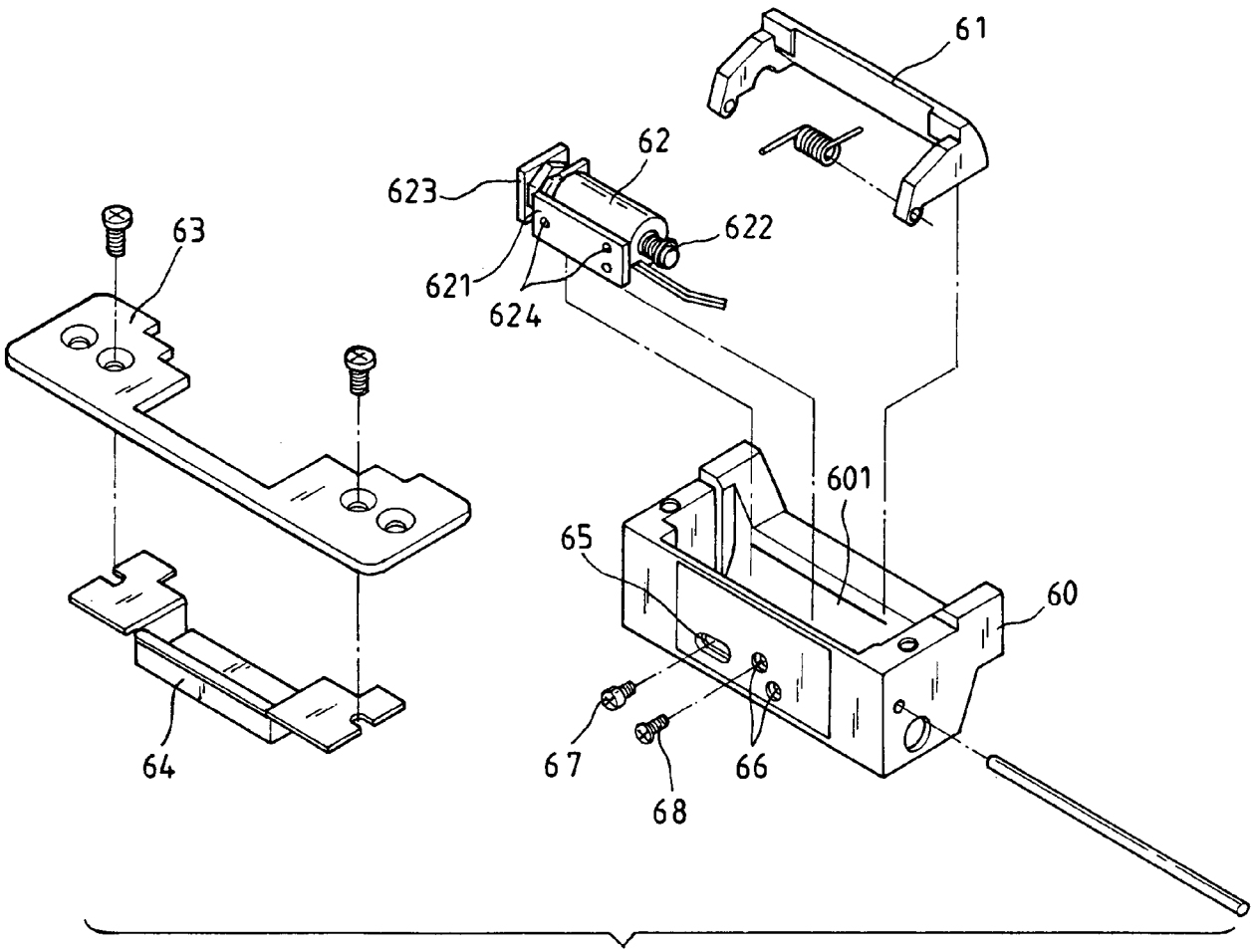
FIG.1A (PRIOR ART)
FIG. 1A is an exploded view of an electrical lock device according to U.S. Pat. No. 6,299,225.
Figure 1B:
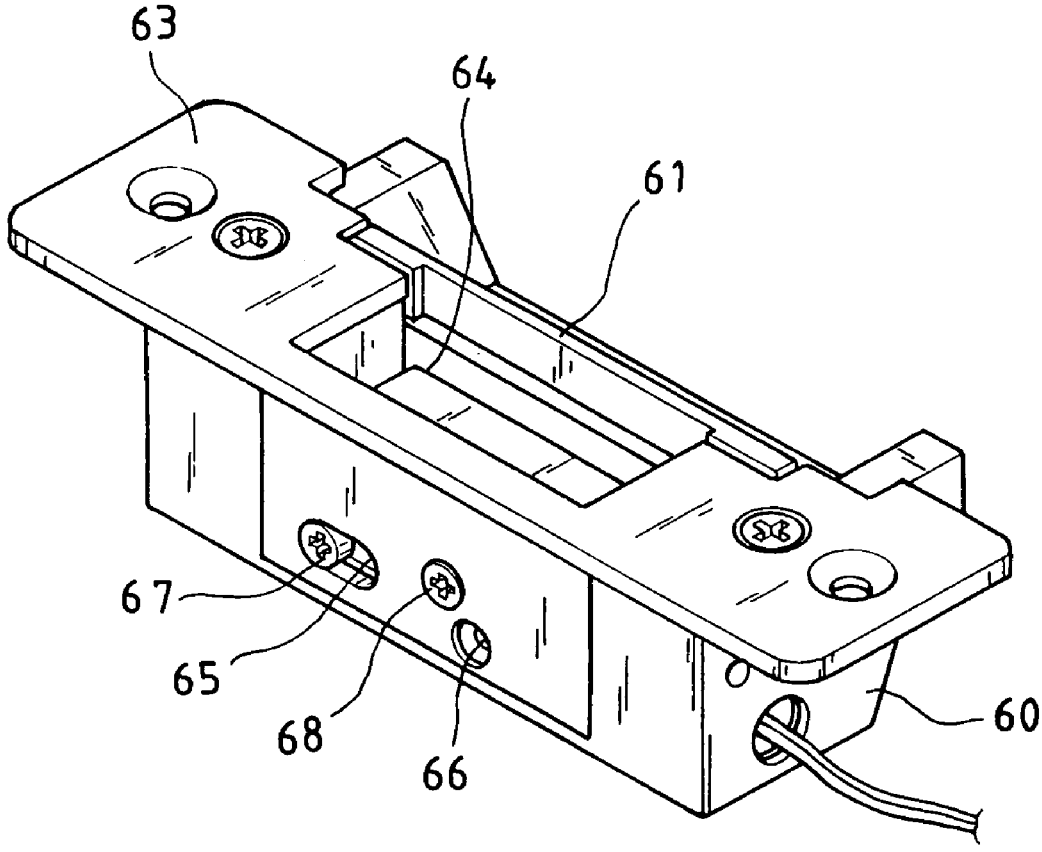
FIG.1B (PRIOR ART)
FIG. 1B is an elevational assembly view of the electrical lock device according to U.S. Pat. No. 6,299,225.
Figure 2A:
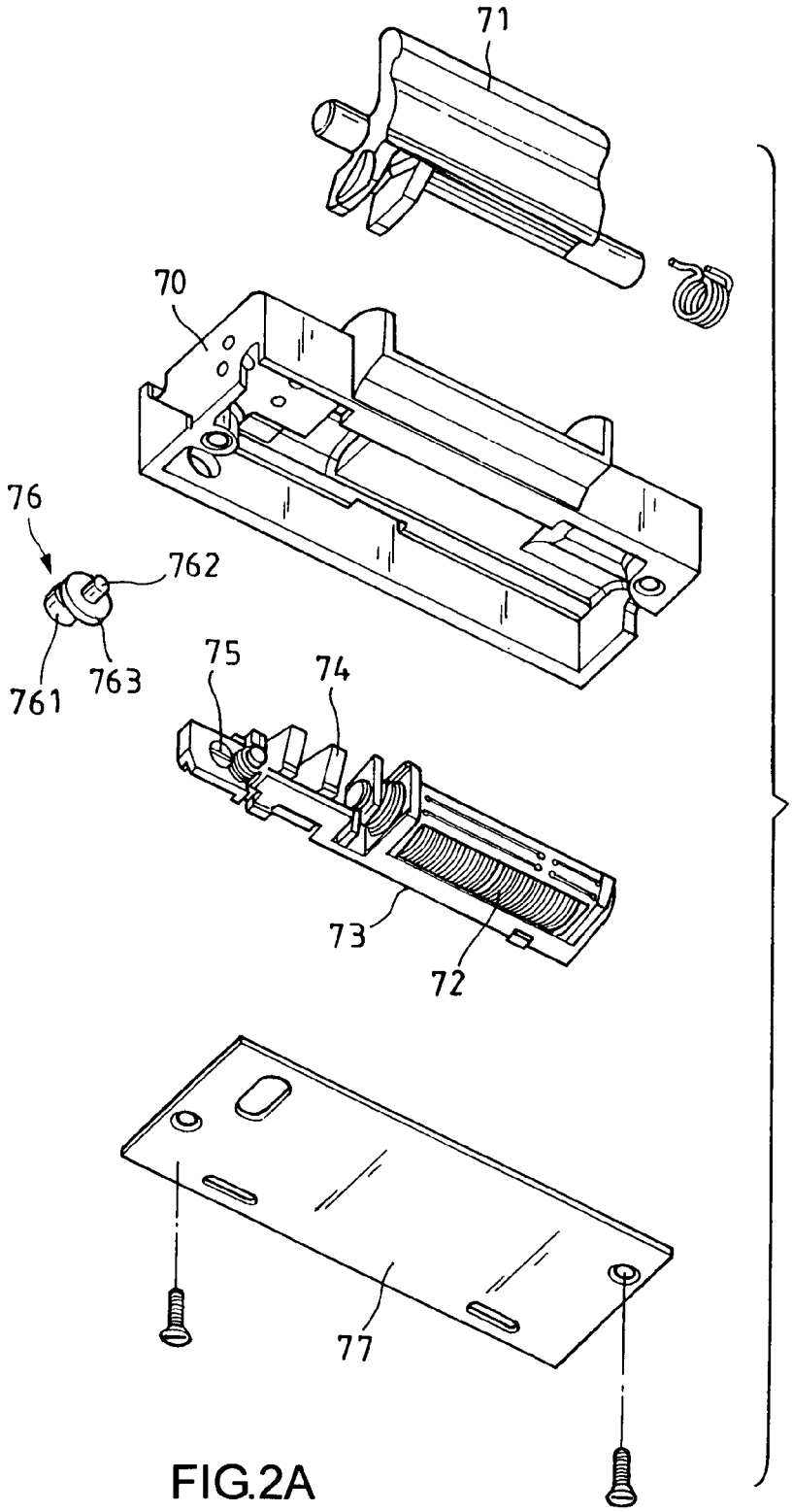
FIG.2A (PRIOR ART)
FIG. 2A is an exploded view of an electric strike assembly according to U.S. Pat. No. 6,874,830.
Figure 2B:
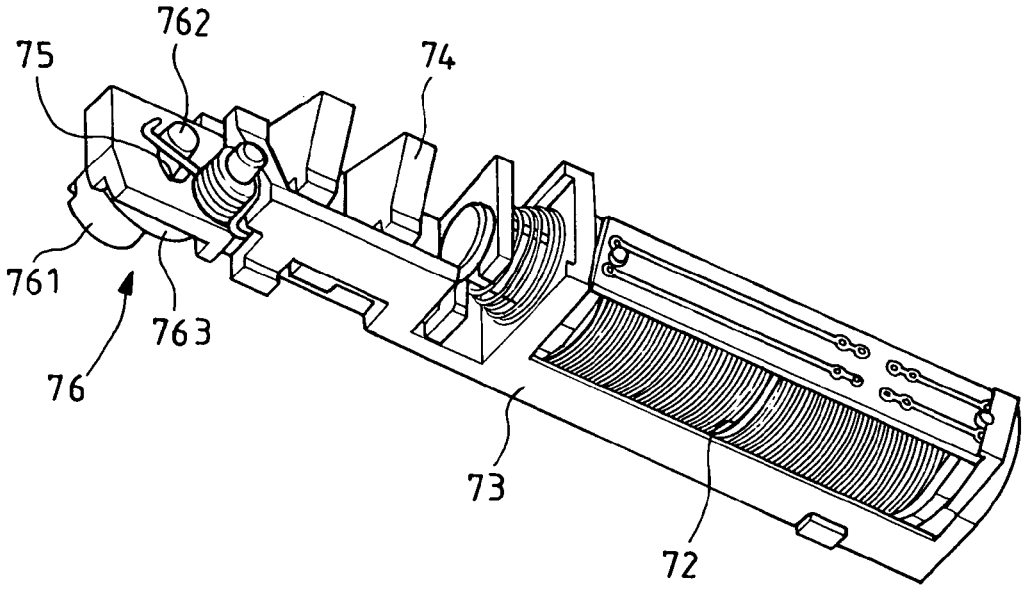
FIG.2B (PRIOR ART)
FIG. 2B is an elevational assembly view of a part of the electric strike assembly according to U.S. Pat. No. 6,874, 830.
Figure 2C:
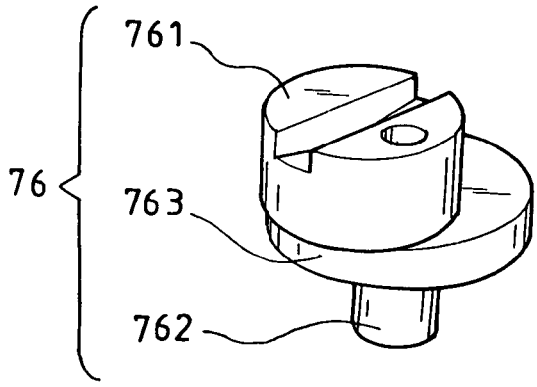
FIG.2C (PRIOR ART)
FIG. 2C is an elevational view of the mode selector for the electric strike assembly according to U.S. Pat. No. 6,874, 830.
Figure 3:
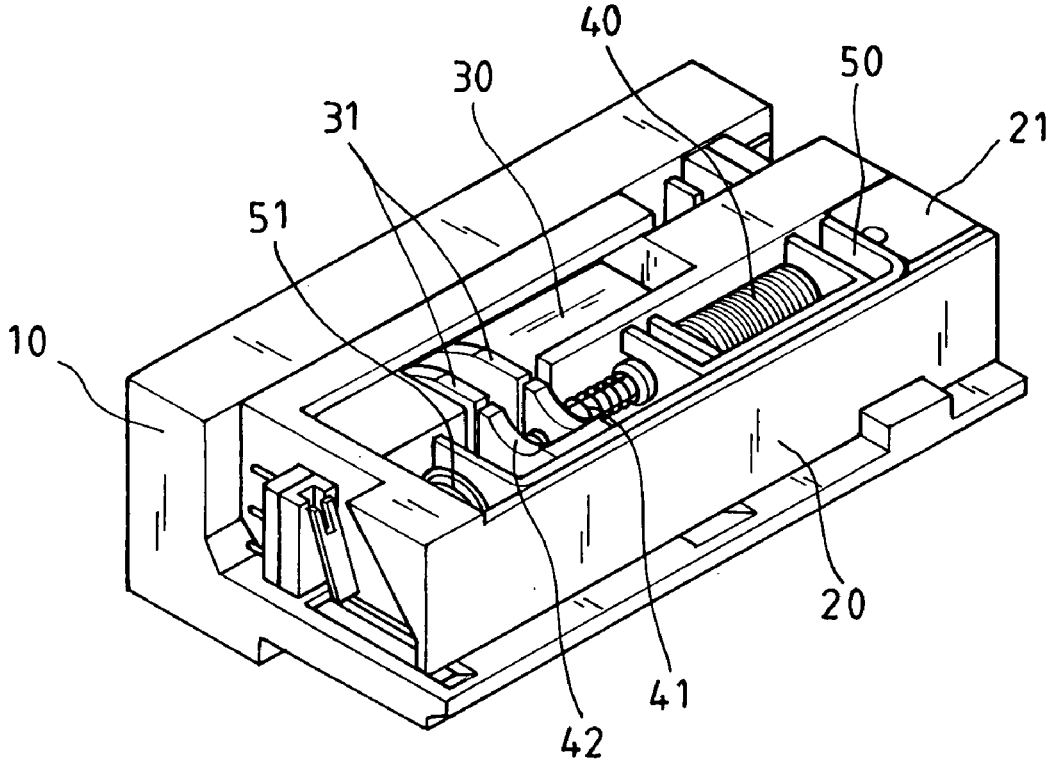
FIG. 3 is an elevational view of a magnetic lock according to the present invention.
Figure 4:
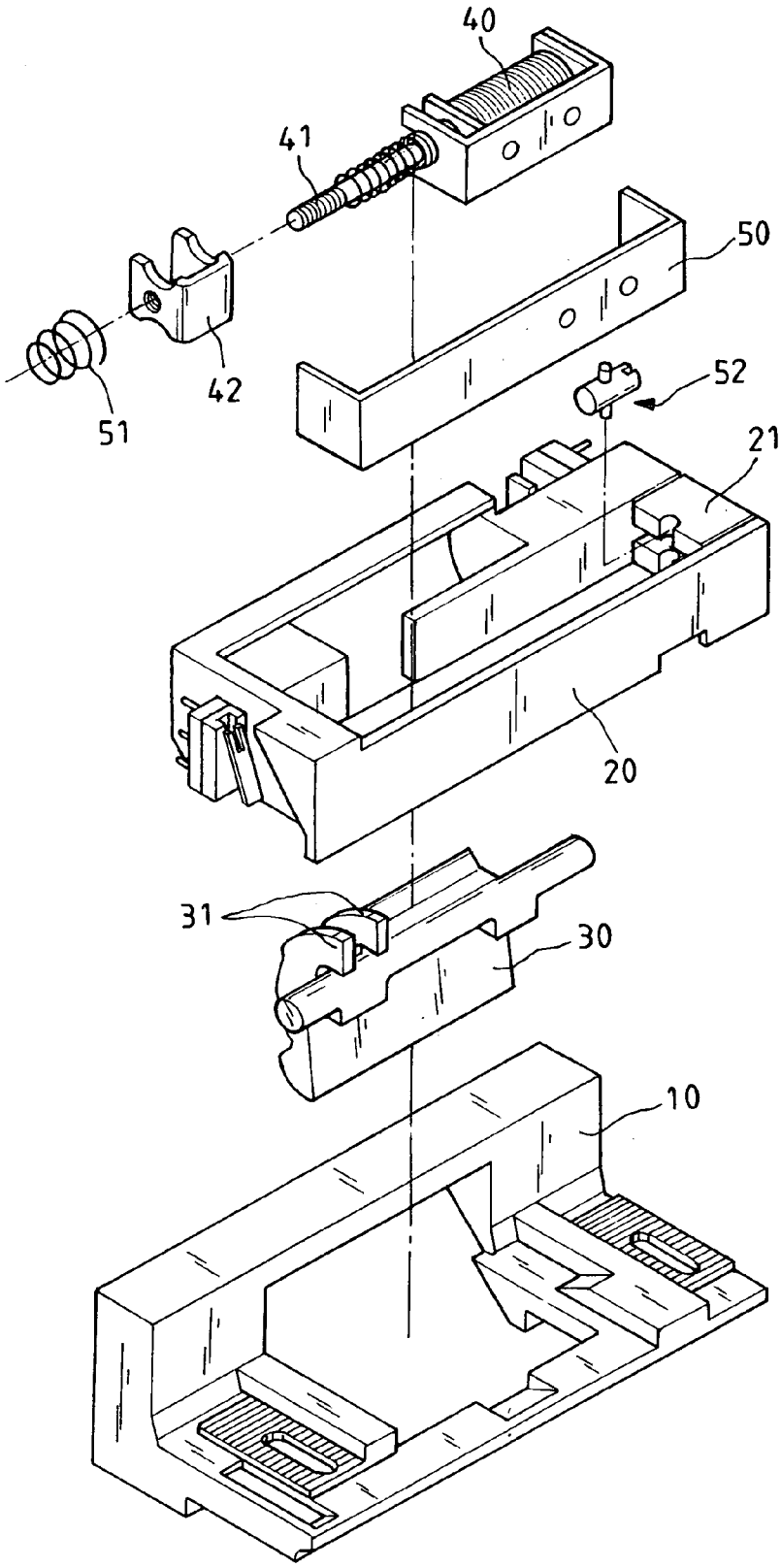
FIG. 4 is an exploded view of the magnetic lock according to the present invention.

Referring to FIGS. 3 and 4, a magnetic lock in accordance with the present invention is shown comprised of a bottom cover shell 10, a top cover shell 20, a latch 30, a solenoid device 40, and a movable holder member 50 that carries the solenoid device 40. The top cover shell 20 mounted on the bottom cover shell 10. Alternatively, the top cover shell 20 and the bottom cover shell 10 may be formed in integrity. The latch 30 is mounted in the top cover shell 20, having two lugs 31 arranged in parallel.

The solenoid device 40 has a plunger 41 slidably received therein and fixedly mounted with a substantially U-shaped stop block 42 corresponding to the keeper 30. The movable holder member 50 is movably mounted inside the top cover shell 20 and adapted to control the return stroke of the latch 30. The movable holder member 50 has one end supported on a spring member, for example, a compression spring 51 in one end of the top cover shell 20 and the other end stopped against an adjustment device 52, which is mounted in a locating block 21 in the other end of the top cover shell 20.

Figure 5:
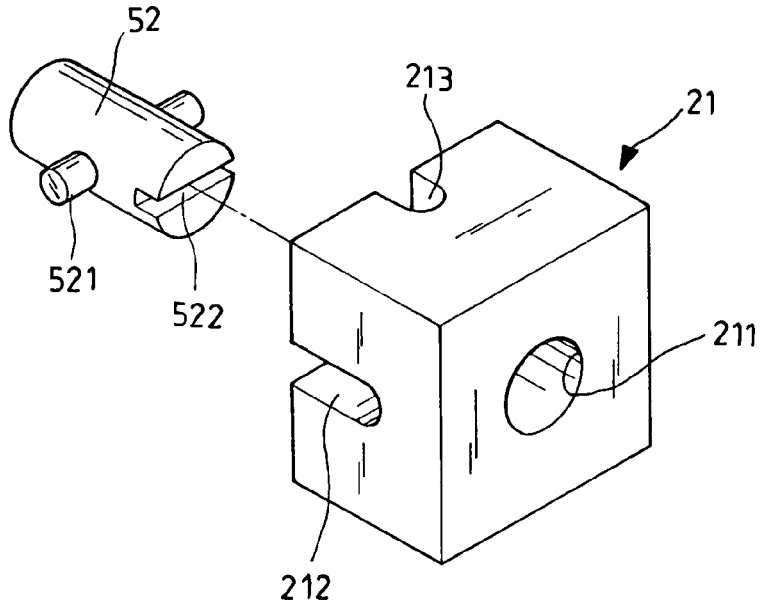
FIG. 5 is an exploded view of a part of the present invention, showing the relationship between the locating block and the adjustment device according to the present invention.
Figure 6:
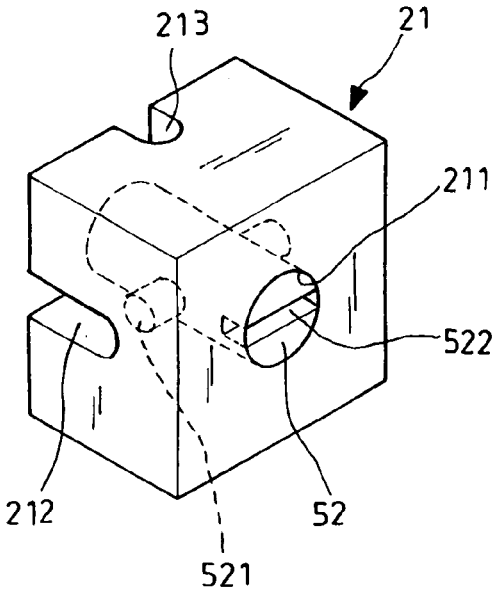
FIG. 6 is a schematic perspective view showing the pins of the adjustment device positioned in the longitudinal groove of the locating block according to the present invention.
Figure 7:
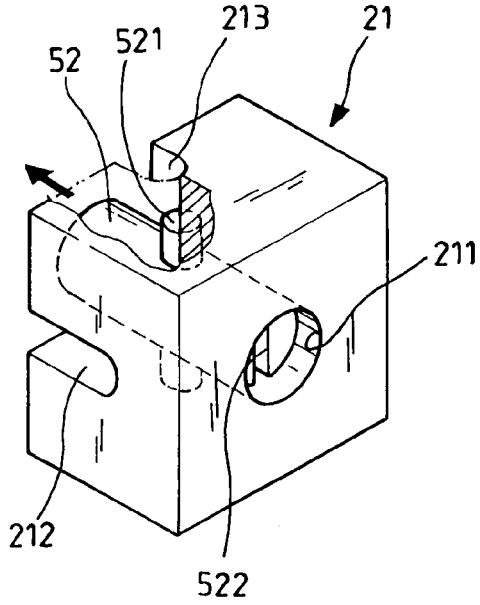
FIG. 7 is a schematic perspective view showing the pins of the adjustment device positioned in the transverse groove of the locating block according to the present invention.

Referring to FIGS. 5~7, the locating block 21 is fixedly provided at one end of the top cover shell 20, having an axle hole 211, which receives the adjustment device 52, a transverse groove 212 extending across the axle hole 211, and a longitudinal groove 213 extending across the axle hole 211 and intersected with the transverse groove 212 at the axle hole 211. The depth of the transverse groove 212 is deeper than the longitudinal groove 213. The adjustment device 52 is a rod member having two pins 521 perpendicularly extending from the periphery at two sides and aligned in a line and selectively pivotally received in the transverse groove 212 or the longitudinal groove 213, and a tool notch 522 at one end. The axle hole 211 extends to the outside of the top cover shell 20. The tool notch 522 faces the outside of the top cover shell 20. Therefore, the user can engage a tool, for example, a screwdriver into the tool notch 522 to adjust the adjustment device 52 between the position shown in FIG. 6 where the pins 521 are positioned in the longitudinal groove 213, and the position shown in FIG. 7 where the pins 521 are positioned in the transverse groove 212. Further, the locating block 21 can be formed with the top cover shell 20 in integrity.

Figure 8:
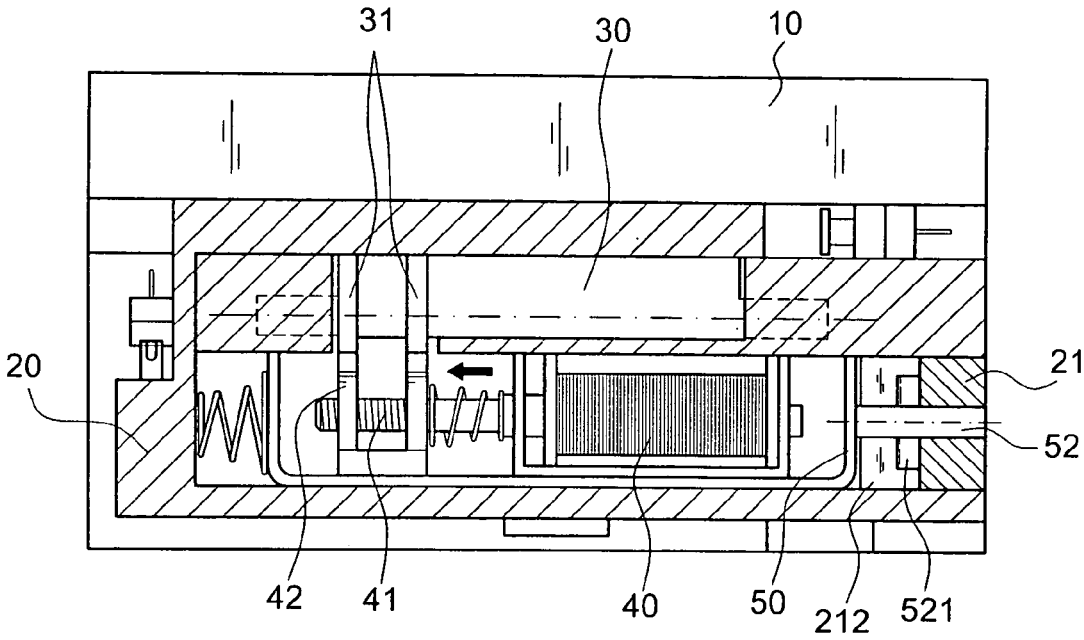
FIG. 8 is schematic sectional view showing the mode of "unlocking upon connection of electricity" of the magnetic lock before connection of electricity according to the present invention.
Figure 9:
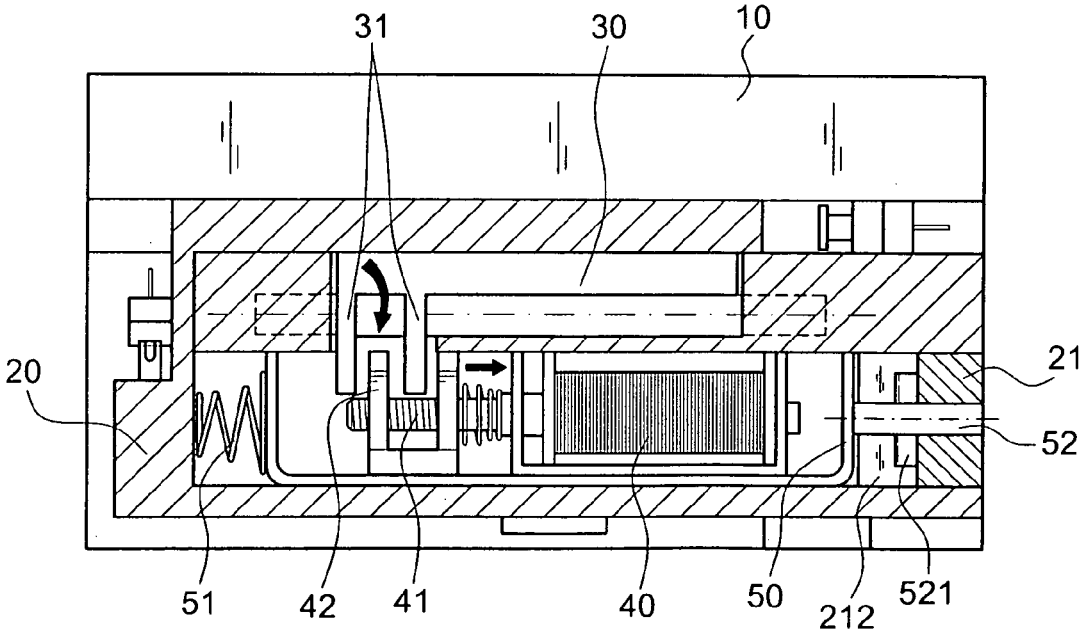
FIG. 9 is a schematic sectional view showing the mode of "unlocking upon connection of electricity" of the magnetic lock after connection of electricity according to the present invention.

Referring to FIGS. 8 and 9, when the pins 51 of the adjustment device 52 are positioned in the transverse groove 212 of the locating block 21, the adjustment device 52 is received inside the locating block 21, and the latch 30 is forced rightwards toward the inside of the locating block 21. At this time, the stop block 42 is stopped against the lugs 31 of the latch 30 to prevent return stroke of the latch 30 when the solenoid device 40 is not energized. When the solenoid device 40 is energized to retract the plunger 41 and the stop block 42, the stop block 42 does not hinder backward movement of the latch 30. Therefore, the magnetic lock is unlocked when electrically connected under this mode.

Figure 10:
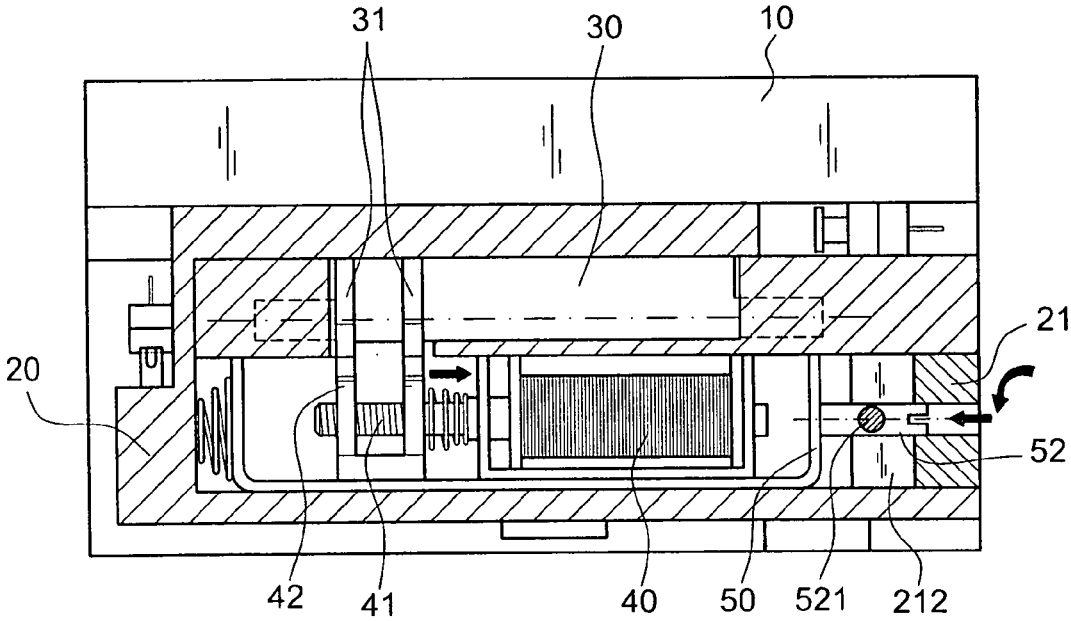
FIG. 10 is a schematic sectional view showing the mode of "locking upon connection of electricity" of the magnetic lock before connection of electricity according to the present invention.
Figure 11:
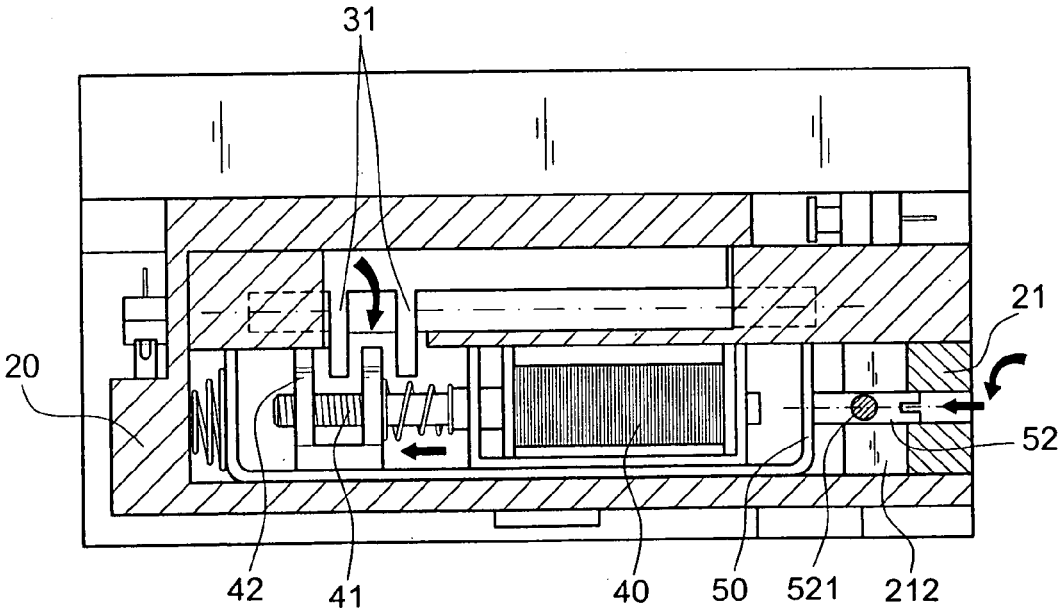
FIG. 11 is a schematic sectional view showing the mode of "locking upon connection of electricity" of the magnetic lock after connection of electricity according to the present invention.

Referring to FIGS. 10 and 11, when the pins 51 of the adjustment device 52 are positioned in the longitudinal groove 213 of the locating block 21, the adjustment device 52 has a part protrude over one end of the axle hole 211 and forcing the latch 30 leftwards against the spring 51. When the solenoid device 40 is not energized to retract the plunger 41 at this time, the stop block 42 is stopped to and stopped at the lugs 31 of the latch 30 to prevent return stroke of the latch 30, and therefore the magnetic lock is locked when electrically connected. On the contrary, when the solenoid device 40 is disenergized at this time, as shown in FIG. 11, the plunger 41 and the stop block 42, the stop block 42 is moved away from the lugs 31 of the latch 30, and the latch 30 is retracted from the locking position to the unlocking position.

A prototype of magnetic lock has been constructed with the features of the annexed drawings of FIGS. 3~11. The magnetic lock functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A magnetic lock comprising:

a bottom cover shell;

a top cover shell mounted on said bottom cover shell;

a latch movably mounted inside said top cover shell, said latch having at least one lug;

a movable holder member mounted inside said top cover shell;

a positioning structure adapted to hold said movable holder member in said top cover shell in position; and a solenoid mounted on said movable holder member, said solenoid device having a plunger slidably received therein and a stop block fastened to said plunger and adapted to act relative to said at least one lug of said latch to control movement of said keeper;

wherein said positioning structure comprises a spring member provided at one end of said top cover shell and stopped against one end of said movable holder member, a locating block provided at an opposite end of said top cover shell and aimed at said spring member, said locating block having an axle hole, a transverse groove for supporting said movable holder member in a first position, and a longitudinal groove for supporting said movable holder member in a second position, said transverse groove and said longitudinal groove being formed on a front face of said locating block at different depths, and an adjustment device mounted in said axle hole of said locating block and stopped at one end of said movable holder member opposite to said spring member and adjustable to control the position of said movable holder member between said first position and said second position, said adjustment device being a rod member mounted in said axle hole and having at least one peripheral pin for selectively positioning in said transverse groove and said longitudinal groove to selectively support said movable holder member in said first position and said second position.

2. The magnetic lock as claimed in claim 1, wherein said top cover shell and said bottom cover shell are integrally formed.

3. The magnetic lock as claimed in claim 1, wherein said top cover shell and said bottom cover shell are two separate members fastened together.

4. The magnetic lock as claimed in claim 1, wherein said locating block is formed integral with said top cover shell.

5. The magnetic lock as claimed in claim 1, wherein said locating block and said top cover shell are separated members fastened together.

6. The magnetic lock as claimed in claim 1, wherein the number of said at least one lug of said latch is 2, and the two lugs of said latch are arranged in parallel; the stop block of said solenoid device has a U-shaped profile.

7. The magnetic lock as claimed in claim 1, wherein said longitudinal groove is relatively deeper than said transverse groove.

8. The magnetic lock as claimed in claim 1, wherein the number of said at least one pin is 2, and the two pins are respectively perpendicularly extending from the periphery of said adjustment device at two sides and aligned in a line.

9. The magnetic lock as claimed in claim 1, wherein said adjustment device has a tool notch disposed at an outer end thereof facing the outside of said top cover shell.

* * * * *